US007326018B2

(12) United States Patent
Huotari

(10) Patent No.: US 7,326,018 B2
(45) Date of Patent: Feb. 5, 2008

(54) METHOD IN GLUE-BINDING AND A BAND FOR USE IN GLUE-BINDING

(75) Inventor: Henri Huotari, Espoo (FI)

(73) Assignee: Maping Ky, Helsinki (FI)

( * ) Notice: Subject to any disclaimer, the term of this patent is extended or adjusted under 35 U.S.C. 154(b) by 543 days.

(21) Appl. No.: 10/810,272

(22) Filed: Mar. 26, 2004

(65) Prior Publication Data

US 2004/0202529 A1 Oct. 14, 2004

(30) Foreign Application Priority Data

Mar. 26, 2003 (FI) ..... 20030453

(51) Int. Cl.
*B42C 9/02* (2006.01)

(52) U.S. Cl. ..... 412/8; 412/6; 412/22; 412/34

(58) Field of Classification Search ..... 412/4, 412/6, 8, 18, 19, 22, 33, 34, 36, 37; 281/21.1; 156/212, 227, 908
See application file for complete search history.

(56) References Cited

U.S. PATENT DOCUMENTS

| | | | | |
|---|---|---|---|---|
| 3,786,529 | A * | 1/1974 | Bendror et al. | 412/1 |
| 3,788,921 | A * | 1/1974 | Polit et al. | 156/216 |
| 4,158,587 | A * | 6/1979 | Keller et al. | 156/216 |
| 5,078,563 | A * | 1/1992 | Lolli | 412/8 |
| 5,193,962 | A * | 3/1993 | Parker et al. | 412/8 |
| 5,250,318 | A * | 10/1993 | Tooker | 427/8 |
| 5,413,447 | A * | 5/1995 | Rathert | 412/19 |

* cited by examiner

*Primary Examiner*—Monica Carter
*Assistant Examiner*—Eric A. Gates
(74) *Attorney, Agent, or Firm*—Skinner & Associates

(57) ABSTRACT

The invention relates to a method for glue-binding a bundle of paper to form a book, booklet, or similar, by using a band, to be glued to the spine of the bundle, and which extends for a limited distance to the sides of the bundle, and which is intended to shape the bundle. The turning of that part of the band, which extends over the spine, to the side of the bundle, is ensured by using a tool, such as a sheet, under the band, which extends sufficiently to lie on top of the nipping beam already in the area outside of the edge of the band.

5 Claims, 4 Drawing Sheets

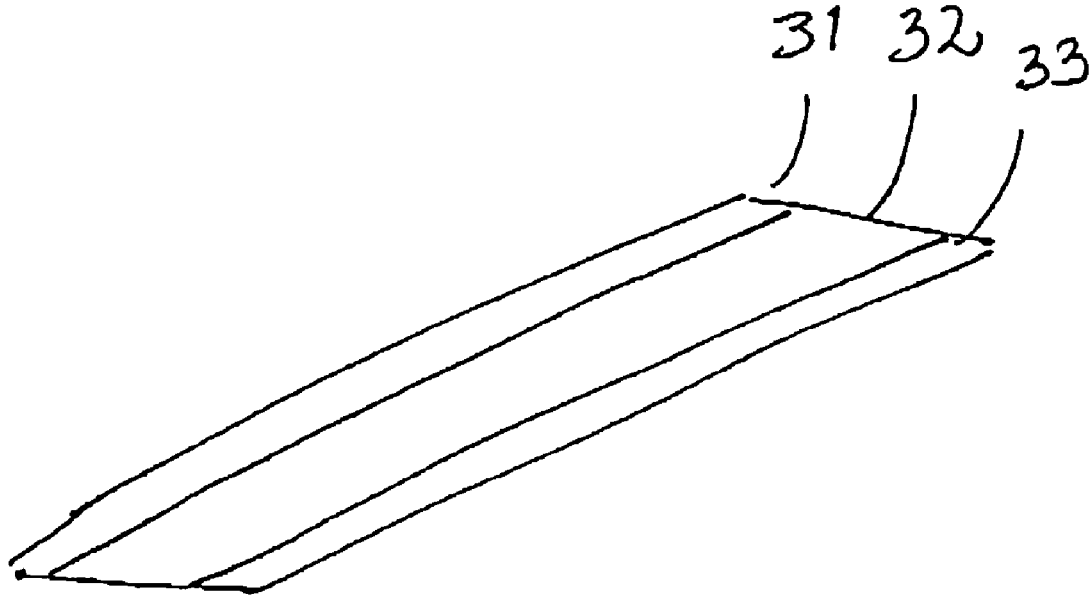
Fig 5
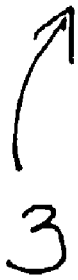

METHOD IN GLUE-BINDING AND A BAND FOR USE IN GLUE-BINDING

BACKGROUND

1. Field

The present invention relates to a method for glue-binding bundles of paper into either soft covers or hard covers, and a band, which is used in the said method.

2. Background Information

Glue-binding is a widely used method of binding a bundle of paper to form a neat booklet or book for later use. Numerous types of glue-binding devices are known, some of which have a rotatable gluing table, to which the paper bundle is secured, the table being rotated, for gluing the spine, to a position in which a suitable device is used to spread hot glue on the spine, the table being then rotated back for the glue to dry, after which the subsequent operations are performed.

The bundle of material is secured and the spine shaped, by using so-called side nipping, in which pressing/shaping takes place using a suitable rigid nipping beam.

In one glue-binding method, a separate band is glued to the spine of the book or booklet, which band usually has a glued surface, generally protected by one or two detachable protective strips of, for example, silicon-impregnated paper. The band is often of plastic-coated fabric and the side of it that will remain visible can be patterned, figured, or otherwise finished to be aesthetically pleasing. On the other hand, the band can be of some other material, for example, book-binding gauze. The width of the band is sufficient to cover the spine of the book or booklet and to extend for a certain distance over both sides of the spine. Alternatively, the band can be attached to soft or hard covers, with the aid of the glued surfaces protected by strips. When the covers are of a wrap-around type, their hardness or softness is of no significance. The glued surfaces then face outwards. If the glued surfaces face inwards, the intention is to attach them to separate front and back covers.

Though the use of the aforesaid band is a versatile and desirable method, problems arise from the fact that the band crumples easily during side-nipping. This is because, as the side-nipping beam moves towards the band, it catches the band's edge and crumples the band in front of it. The band could perhaps be lifted manually or with some mechanical device to avoid crumpling, but in any case this would be a difficult procedure with no certainty of success. It is therefore not applicable in any kind of continuous work.

The present invention is therefore intended to create a method, which will permit full-scale, unimpeded hot-gluing work to be carried out, even when using a narrow band, without the problems caused by crumpling.

BRIEF SUMMARY

The present invention provides a glue-binding method and a band for use in glue-binding which is practical, reliable, accurate and efficient, and which is believed to fulfil a need and to constitute an improvement over the background technology.

In one aspect, the invention relates to a method for glue-binding a bundle of paper to form a book, booklet, or similar, by using a band, to be glued to the spine of the bundle, and which extends for a limited distance to the sides of the bundle, and which is intended to shape the bundle and secure it using the said glue, characterised in that the turning of that part of the band, which extends over the spine, to the side of the bundle, is ensured by using a tool, such as a sheet, under the band, which extends sufficiently to lie on top of the nipping beam, already in the area outside of the edge of the band.

The aforesaid and other advantages and benefits of the invention are achieved in the manner stated to be characteristic in the accompanying claims.

BRIEF DESCRIPTION OF THE SEVERAL VIEWS OF THE DRAWING

In the following, the invention is examined with reference to the accompanying drawings, which show the work stages of the invention.

Thus.

FIG. 5 shows the band to be used, according to the invention.

DETAILED DESCRIPTION

Figure 1:
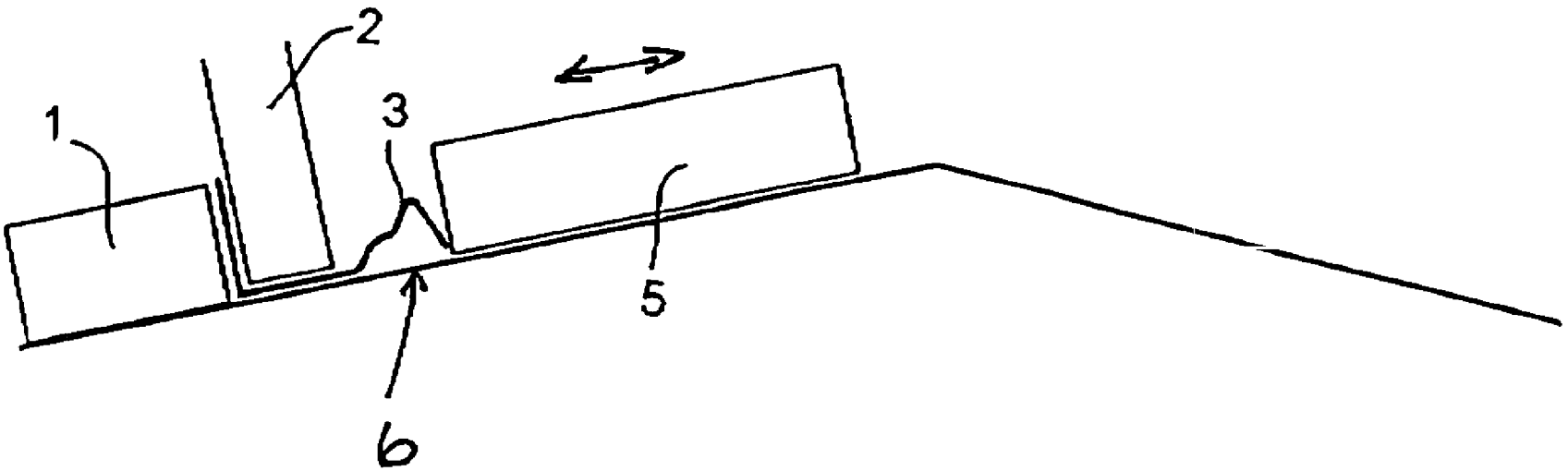
FIG. 1 shows the problem besetting the prior art.

Thus, FIG. 1 shows what happens when working without the aid provided by the present invention. Thus, there is a stop on top of the nipping table 6, against which the band 3 of material described above, which is shown in greater detail in FIG. 5, is bent, and on top of which band a bundle 2 of paper, supported in a manner not shown, is placed. The intention is to glue the spine of the bundle and also to glue the band 3 onto the spine. After placing, the side-nipping beam 5 is brought from the side, with the purpose of shaping the band between the support 1 and the beam, to conform the shape of the edge of the bundle. After this, the spine of the bundle is turned upwards for gluing, suitably pressed between supports at a distance from the edge of the bundle, and, after gluing, is returned to the position shown in the figure, in which position the glue is allowed to cool for a moment, before the pressure is removed.

As is unambiguously shown by the figure, the edge of the band 3 is in absolutely the wrong place to be turned smoothly against the nip, and thus unavoidably results in the band being crumpled, as shown in FIG. 1.

According to the invention, the solution to this problem is to use a tool 4, to ensure that bending takes place as desired.

Figure 2A:
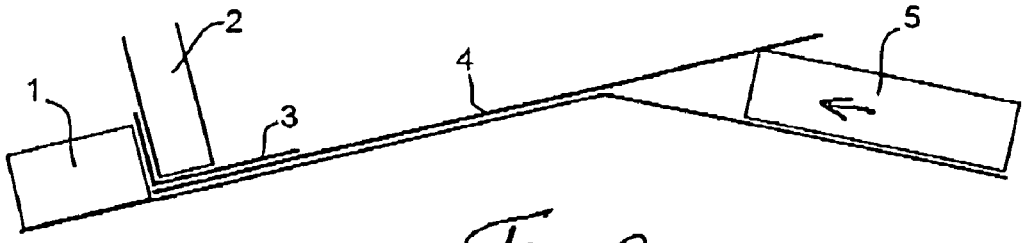
FIGS. 2*a*-2*c* show the work stages of the method according to the invention.
Figure 2B:
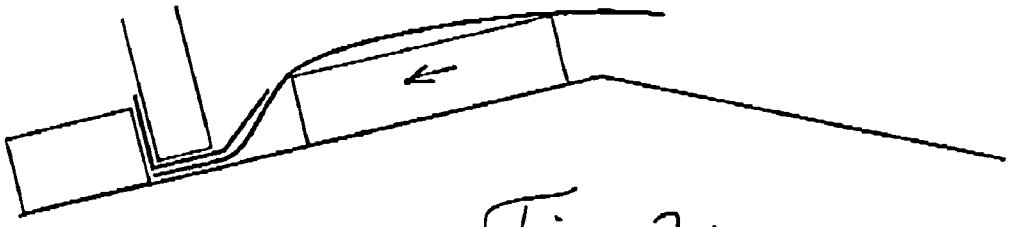
Figure 2C:
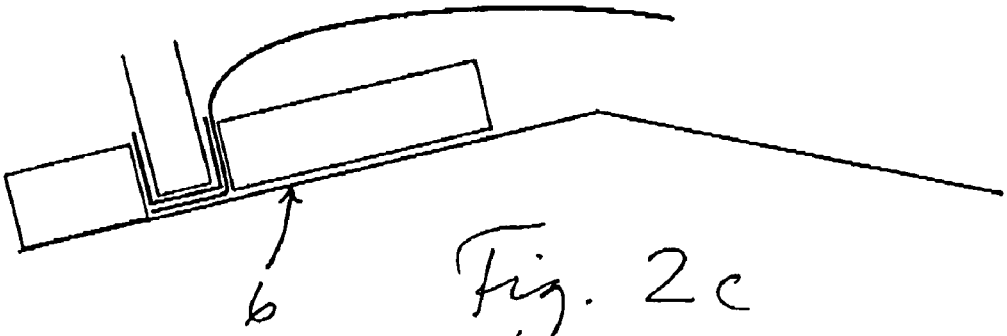

Thus, FIGS. 2*a*-2*c* show how a separate, usually sheet-like tool 4 is used under the band 3, and extends in such a way that it is in place on top of the side-nipping beam 5 in good time before it 5 reaches the position of the band 3, so that when the side-nipping beam moves towards the band 3, the tool permits it to travel undisturbed and simultaneously raise the edge of the band 3 smoothly to the desired position.

Figure 3:
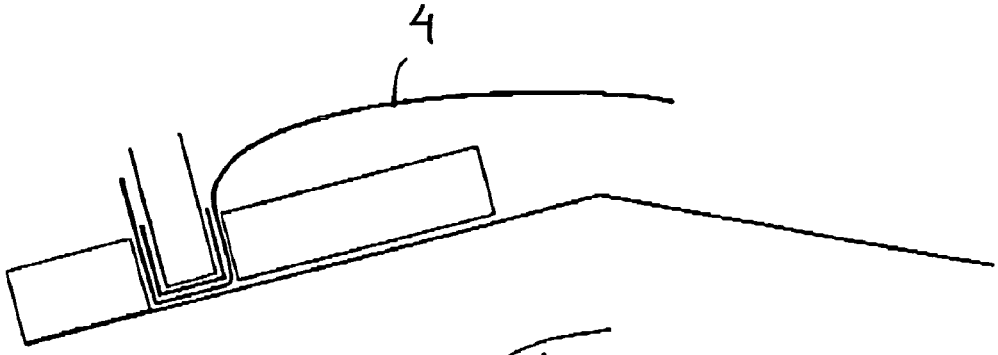
FIG. 3 shows an alternative arrangement of the situation of FIG. 2*c*.

In FIGS. 2*a*-2*c*, the sheet-like tool 4 is of a type that terminates at the side support, or in its immediate vicinity, whereas the image of FIG. 3, which is similar to that of FIG. 2*c*, shows that the sheet-like tool 4 can very well extend to the other side of the bundle 2. A fold is then made in the sheet 4, and is placed in the angle between the side support 1 and the work bench 6. The tool 4 can be a separate sheet-like device, or if so desired, it can be attached to the apparatus, preferably in an easily detachable manner.

Figure 4A:
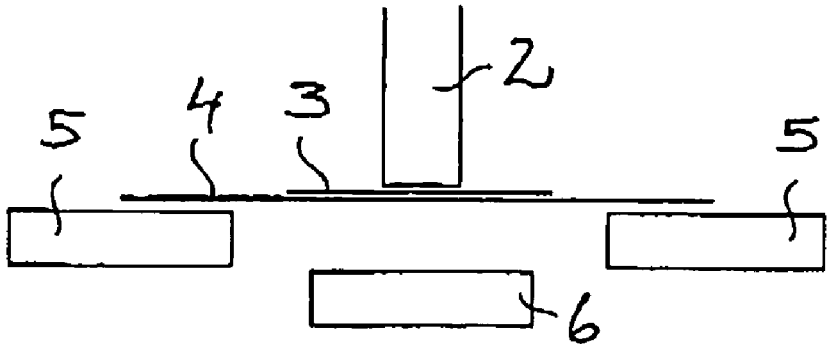
FIGS. 4*a*-4*c* show illustration of the work stages, similar to those of FIG. 2, in two-sided nipping.
Figure 4B:
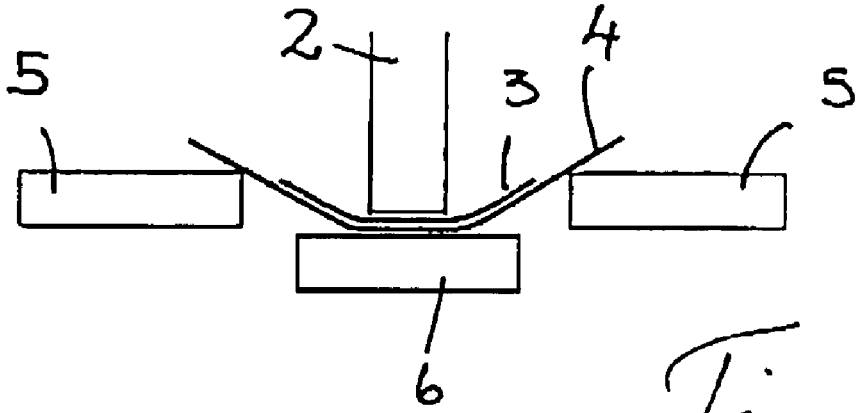
Figure 4C:
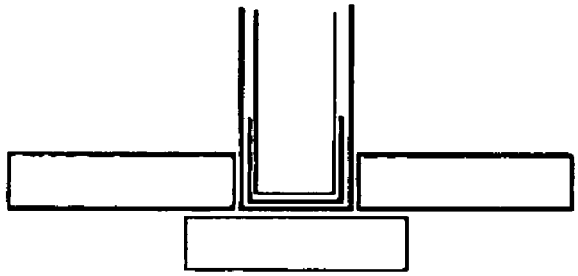

FIGS. 4*a*-4*c* show analogously the situation when two-side nipping is used. The numbering is the same as in the previous figures, the series of figures requiring practically no explanation, as the only difference from the previous series is that the nipping takes place from both sides. In this embodiment, there are thus two side-nipping beams 5.

FIG. 5 shows the band 3 in its basic unfolded state. This band includes two glued surfaces 31, preferably protected with silicon-impregnated paper strips, with a glue-free area 32 between them, which essentially corresponds to the width of the bundle, or is slightly wider than it. In other words, the band can, if desired, be glued to the bundle not only symmetrically, but also asymmetrically, so that it extends for a different distance on each side of the bundle.

The band 3 is usually folded along the edge of the unglued area of one glued surface 31, so that it lies in a suitable working position in the glue-binding device, as described above.

The band 3 can, if desired, be used in such a way that the glued surfaces 31 face outwards from the spine, so that the glued surfaces 31 are attached to an wrap-around hard or soft cover. However, if the band 3 is placed with the glued side facing the bundle, the intention is to bind it, by the glue surfaces 31, to the outer surfaces of separate front and back covers.

It is obvious that the invention can be adapted in many ways. Thus, clearly the easiest way is to use a sheet-like device, for example, a sturdy sheet of paper or film, as the tool. But the tool need not necessarily be sheet-like. It is obvious that the tool must support the band 3 in a sufficient number of places for the operation to be ensured, but the support can also be implemented using a few support points over the width of the bundle, which will ensure smooth bending. The tool could then instead be plank-shaped or strip-shaped. It should be noted that the tool 4 plays no part whatsoever in the actual gluing, but only acts as an ancillary device.

The invention claimed is:

1. A method for glue-binding a bundle of paper to form a book, booklet, or similar bound bundle of paper, comprising the steps of providing a band to be glued to the spine of the bundle, and which extends for a limited distance to the sides of the bundle, and which is adapted to shape the bundle and secure it using the glue, characterized by the steps of placing a sheet-like tool under the band, the tool extending a distance on at least one side of the bundle to lie on top of a nipping beam disposed in an area outside of the side edge of the band, turning that part of the band, which extends over the spine to the side of the bundle by moving the nipping beam towards the bundle, whereby the nipping beam causes the tool to raise the side edge of the band without crumpling the band, and removing the shaped bundle from the tool.

2. A method according to claim 1, characterized in that the tool is formed from a bendable sheet of paper or plastic, which retains its shape well.

3. A method according to claim 2, characterized in that the tool is positioned beneath the band on a table of a hot-gluing device.

4. A method according to any of the above claims, characterized in that the tool has two opposing edges, one such edge lying on top of the nipping beam, the other such edge abutting a support.

5. A method for glue-binding a bundle of paper to form a book, booklet, or similar bound bundle of paper, comprising the steps of:

(a) providing a gluing device having a nipping table and at least one nipping beam which is moveable with respect to the nipping table;

(b) providing a bundle of paper having a spine and opposing sides;

(c) placing a band adapted to be glued to and shape the bundle, adjacent the spine, the band extending a predetermined distance to the sides of the bundle, the nipping beam being disposed in an area outside of the side edge of the band;

(d) disposing a sheet-like tool over the nipping table and under the band, the tool extending a predetermined distance beyond at least one side of the bundle so that it lies above of the nipping beam, the tool is constructed of a bendable, shape retaining material, (e) moving the nipping beam towards the bundle, whereby the nipping beam slidingly engages the tool and causes it to raise the side edge of the band without crumpling the band, and whereby the nipping beam turns that part of the band, which extends over the spine to the side of the bundle; and (f) removing the shaped bundle from the tool.

* * * * *